US010993507B2

(12) United States Patent
Cha et al.

(10) Patent No.: US 10,993,507 B2
(45) Date of Patent: May 4, 2021

(54) NO-NOISE DETACHABLE BABY CARRIER BELT

(71) Applicants: Bok-Hee Cha, Seoul (KR); Hee-Jun Chae, Seoul (KR); Hee-Dae Chae, Seoul (KR)

(72) Inventors: Bok-Hee Cha, Seoul (KR); Hee-Jun Chae, Seoul (KR); Hee-Dae Chae, Seoul (KR)

( * ) Notice: Subject to any disclaimer, the term of this patent is extended or adjusted under 35 U.S.C. 154(b) by 29 days.

(21) Appl. No.: 16/330,898

(22) PCT Filed: Jun. 30, 2017

(86) PCT No.: PCT/KR2017/006935
§ 371 (c)(1),
(2) Date: Jun. 27, 2019

(87) PCT Pub. No.: WO2018/048076
PCT Pub. Date: Mar. 15, 2018

(65) Prior Publication Data

US 2019/0365057 A1 Dec. 5, 2019

(30) Foreign Application Priority Data

Sep. 7, 2016 (KR) ..... 20-2016-0005281

(51) Int. Cl.
*A44B 11/25* (2006.01)
*A44B 17/00* (2006.01)
(Continued)

(52) U.S. Cl.
CPC ..... *A44B 11/25* (2013.01); *A44B 17/0058* (2013.01); *A44B 17/0064* (2013.01);
(Continued)

(58) Field of Classification Search
CPC ..... A44B 19/00; A44B 11/25; A44B 17/0058; A44B 17/0064; A47D 13/02; A47D 15/00
(Continued)

(56) References Cited

U.S. PATENT DOCUMENTS 5,224,637 A 7/1993 Colombo
D375,184 S * 11/1996 Hickli ..... D3/213
(Continued)

FOREIGN PATENT DOCUMENTS

CN 203987147 U 12/2014
EP 0 744 136 A2 11/1996
(Continued)

OTHER PUBLICATIONS

Japanese Office Action dated Feb. 19, 2019 in counterpart Japanese Patent Application No. 2017-567788 (3 pages in Japanese).
(Continued)

*Primary Examiner* — Mark R Wendell
(74) *Attorney, Agent, or Firm* — NSIP Law

(57) ABSTRACT

The present invention relates to a baby carrier belt, and more particularly, to a no-noise detachable baby carrier belt, which does not generate noise when the belt is fastened and unfastened so as to prevent a baby or an infant who is sleeping in a baby carrier from awaking from sleep due to noise generated when the belt is fastened and unfastened.

7 Claims, 6 Drawing Sheets

(51) Int. Cl.
*A47D 13/02* (2006.01)
*A47D 15/00* (2006.01)
*A44B 19/00* (2006.01)

(52) U.S. Cl.
CPC ..... *A47D 13/02* (2013.01); *A47D 15/00* (2013.01); *A44B 19/00* (2013.01)

(58) Field of Classification Search
USPC ..... 297/250.1
See application file for complete search history.

(56) References Cited

U.S. PATENT DOCUMENTS

| | | | | |
|---|---|---|---|---|
| 6,766,532 | B1 * | 7/2004 | Cabana | A61F 5/026 2/310 |
| 7,575,136 | B2 * | 8/2009 | Kernkamp | A45F 3/14 224/158 |
| 7,900,278 | B2 * | 3/2011 | Pittman | A45F 3/14 2/310 |
| 9,596,947 | B2 * | 3/2017 | Lee | A47D 13/025 |
| D849,397 | S * | 5/2019 | Tsai | D3/214 |
| D858,089 | S * | 9/2019 | Tsai | D3/214 |
| 10,433,656 | B2 * | 10/2019 | Lundh | A47D 13/025 |
| 2005/0235425 | A1 * | 10/2005 | Parrilla | A47D 13/08 5/655 |
| 2009/0308900 | A1 | 12/2009 | Kernkamp | |
| 2014/0231472 | A1 * | 8/2014 | Cha | A47D 13/025 224/160 |
| 2016/0255968 | A1 * | 9/2016 | Lee | A47D 13/025 |

FOREIGN PATENT DOCUMENTS

| | | | |
|---|---|---|---|
| FR | 2 849 369 | B1 | 2/2005 |
| JP | 2005-89948 | A | 4/2005 |
| JP | 2007-159881 | A | 6/2007 |
| KR | 20-0469068 | Y1 | 9/2013 |
| KR | 20-2013-0006914 | U | 12/2013 |
| KR | 10-2015-0053581 | A | 5/2015 |
| KR | 20-0481152 | Y1 | 8/2016 |

OTHER PUBLICATIONS

Singapore Search Report dated Nov. 7, 2019 in Counterpart Singapore Patent Application No. 11201800877V (2 pages in English).
Singapore Written Opinion dated Nov. 8, 2019 in counterpart Singapore Patent Application No. 11201800877V (6 pages in English).
Extended European Search Report dated Jan. 27, 2020 in counterpart European Patent Application No. 17848960.5 (7 pages in English).
Indonesian Office Action dated May 14, 2020 in counterpart Indonesian Patent Application No. PID 2018 00802 (2 pages in Indonesian).
International Search Report dated Mar. 15, 2018 in International Patent Application No. PCT/KR2017/006935 (4 pages in English, 4 pages in Korean).

* cited by examiner

NO-NOISE DETACHABLE BABY CARRIER BELT

CROSS REFERENCE TO RELATED APPLICATIONS

This application is a U.S. National Stage Application of International Application No. PCT/KR2017/006935, filed on Jun. 30, 2017, which claims the benefit under 35 USC 119(a) and 365(b) of Korean Patent Application No. 20-2016-0005281, filed on Sep. 7, 2016, in the Korean Intellectual Property Office.

TECHNICAL FIELD

The present invention relates to a baby carrier belt, and more particularly, to a no-noise detachable baby carrier belt, which does not generate noise when the belt is fastened and unfastened so as to prevent a baby or an infant who is sleeping in a baby carrier from awaking from sleep due to noise generated when the belt is fastened and unfastened.

BACKGROUND ART

In general, a mother or a father supports his or her baby's weight with the two arms when he or she holds his or her baby, but he or she cannot freely use his or her arms and such a posture is as hard on the arms when he or she holds his or her baby with the two arms for a long time.

Therefore, a mother or a father uses a carrier blanket to carry a baby on his or her back or nestle the baby in his or her breast, but such a carrier blanket is as hard on the shoulders because the baby's weight is concentrated on the mother's or the father's shoulders.

Recently, a baby carrier with a hip seat fastened around a mother's or father's waist and pelvis to disperse the baby's weight has been widely used.

Such a baby carrier includes a waist belt 10 as illustrated in FIG. 1 to fasten the baby carrier on a user's body, a hip seat 11 formed on the waist belt to allow a baby to sit thereon, and a shoulder strap (not shown) detachably attached to the waist belt 10.

The conventional waist belt 10 includes Velcro fasteners 12 formed at both ends of the waist belt 10 to be easily fastened or unfastened around the user's waist, such that the user can fasten and unfasten the waist belt 10 around the user's waist using the Velcro fasteners 12.

However, when the user unfastens the waist belt 10 in order to lay down the baby after lulling the baby to sleep using the baby carrier, the Velcro fasteners 12 generate a loud noise, and so the baby awakes from sleep due to the noise.

DISCLOSURE

Technical Problem

Accordingly, the present invention has been made in an effort to solve the above-mentioned problems occurring in the prior arts, and it is an object of the present invention to provide a no-noise detachable baby carrier belt, which does not generate a loud noise of Velcro fasteners when a user unfastens a waist belt in order to lay down the baby sleeping in a baby carrier so that the baby does not awake from sleep.

Technical Solution

To achieve the above objects, the present invention provides a no-noise detachable baby carrier belt including: a band-type first belt having a belt fastening means formed at one end portion and a Velcro fastener formed at the other end portion of one side thereof; and a band-type second belt having a belt fastening means formed at one end portion to be fastened the first belt and a Velcro fastener formed on one side thereof, wherein the first belt and the second belt are fastened to each other by the belt fastening means to form a waist belt, and the waist belt is released from a user's waist by detaching the Velcro fasteners from each other or by unfastening the belt fastening means in a state where the user wears the waist belt around the user's waist by attaching the Velcro fasteners to each other.

In this instance, the belt fastening means is one of a zipper, a snap button, and a buckle.

Moreover, the no-noise detachable baby carrier belt further includes a safety belt having fastening means for fastening both end portions of the first belt, wherein the safety belt fastens both end portions of the first belt in the state where the user wears the waist belt around the user's waist, such that the zipper is not released unintentionally.

Furthermore, the fastening means are buckles.

Additionally, the first belt further includes a hip seat for supporting a baby's hips.

In addition, the first belt further includes a baby carrier for supporting the baby's upper body.

Advantageous Effects

The no-noise detachable baby carrier belt according to an embodiment of the present invention does not generate a loud noise of Velcro fasteners when a user unfastens a waist belt in order to lay down the baby sleeping in a baby carrier so that the baby does not awake from sleep, and allows the user to rapidly and easily unfasten the waist belt.

EXPLANATION OF ESSENTIAL REFERENCE NUMERALS IN DRAWINGS

Figure 1:
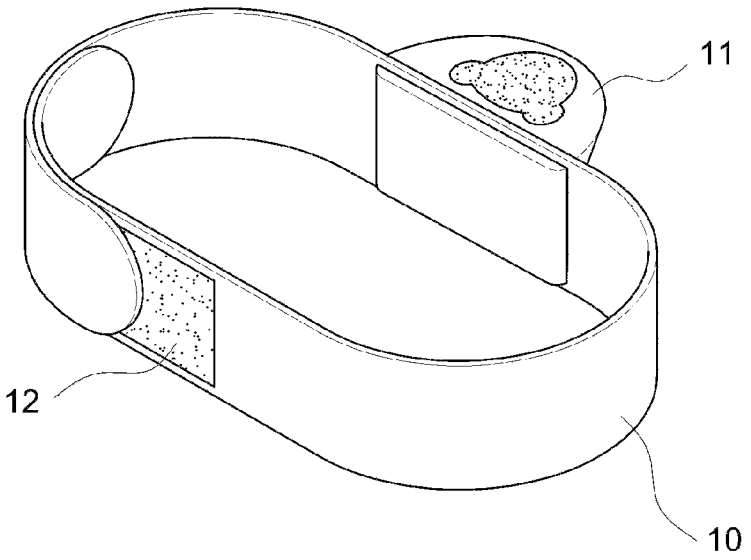
FIG. 1 is a perspective view of a conventional baby carrier belt.

101: Belt
102: First belt
103: Second belt
104: Hip seat
105: Non-slip pad
106: Velcro fastener
107: Zipper
108: Safety belt
109: Fastening buckle
111: Fixed buckle

112: Baby carrier
113: Snap button
114: Buckle

MODE FOR INVENTION

Hereinafter, a preferred embodiment of the present invention will now be described in detail with reference to the attached drawings, in which like reference numbers denote corresponding parts throughout the drawings.

The terms "comprising" and "including" in the discussion directed to the present invention and the claims are used in an open-ended fashion and thus should be interrupted to mean "including", but not limited thereto.

Figure 2:
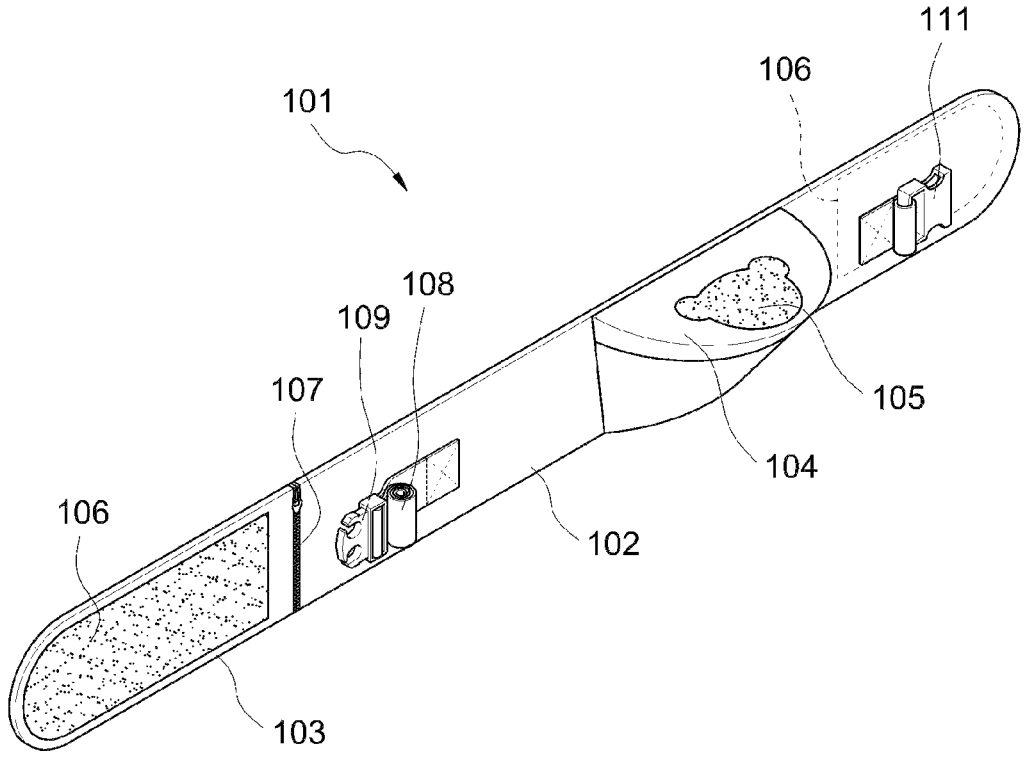
FIG. 2 is a perspective view of a baby carrier belt according to a preferred embodiment of the present invention.

As shown in FIG. 2, a no-noise detachable baby carrier belt according to an embodiment of the present invention includes a first belt 102 and a second belt 103, and the first belt 102 and the second belt 103 are fastened using a zipper 107 as a belt fastening means.

In this embodiment, for the belt fastening means to fasten the first belt 102 and the second belt 103, the zipper 107 is used.

A general zipper includes a pair of zipper rails and a slider sliding along the zipper rails to combine and separate the zipper rails. Hereinafter, the zipper rails, the slider, and other zipper accessories are commonly called a 'zipper 107'.

The first belt 102 has a hip seat 104 formed on one side for allowing a baby or an infant to sit thereon, a Velcro fastener 106 formed at an end portion, and a zipper 107 formed at the other end portion.

The hip seat 104 serves to disperse weight of the baby sitting on the hip seat 104 to a user's waist and pelvis. It is preferable to form a non-slip pad 105 on the hip seat 104 so that the baby or infant sitting on the hip seat 104 does not slip.

Moreover, as shown in FIG. 2, a fastening buckle 109, which has a length-adjustable safety belt 108, is formed at an end portion of the side where the hip seat 104 of the first belt 102 is formed, and a fixed buckle 111 is formed at the other end portion of the side where the hip seat 104.

When the first belt 102 and the second belt 103 are combined together, a waist belt 101 is formed.

The Velcro fastener 106 is formed on one side of the second belt 103 and the zipper 107 is formed at one end portion of the second belt 103, such that the second belt 103 is combined with the first belt 102 by the zipper 107.

The Velcro fastener 106 of the second belt 103 is attached to the Velcro fastener 106 while getting in contact with the Velcro fastener 106 of the first belt 102, such that the waist belt 101 is fastened and fixed on the user's waist.

In this instance, it is preferable that the second belt 103 has the same thickness and width as the first belt 102 such that the first belt 102 and the second belt 103 can provide a sense of integrity when they are coupled by the zipper 107.

Figure 3:
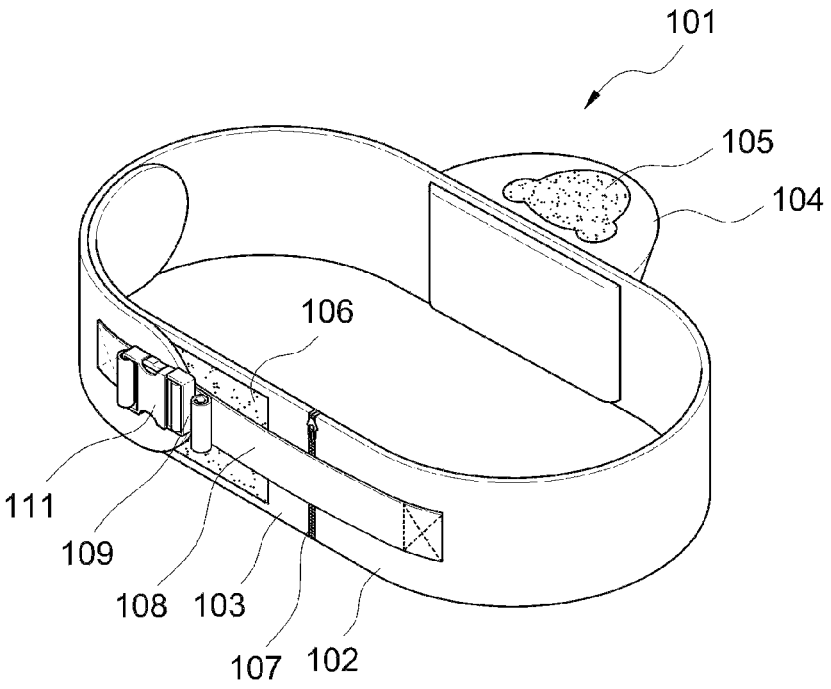
FIGS. 3 to 5 are perspective views showing a process to unfasten the baby carrier belt according to the preferred embodiment of the present invention.

As shown in FIG. 3, the waist belt 101 is fastened around the user's waist when the waist belt 101 is wound around the user's waist and the Velcro fastener 106 of the first belt 102 and the Velcro fastener 106 of the second belt 103 are combined with each other in the state where the first belt 102 and the second belt 103 are coupled by the zipper 107.

Furthermore, as shown in FIG. 3, when the fastening buckle 109 of the first belt 102 is fastened to the fixed buckle 111, both ends of the first belt 102 is connected to the safety belt 108.

In the state where the user wears the waist belt 101 around his or her waist, when the user sits the baby or the infant on the hip seat 104, the baby or the infant may fall down while the zipper 107 is released unintentionally by the baby's or infant's weight. However, as described above, because the safety belt 108 is connected and fixed to both ends of the first belt 102, even though the zipper 107 is released unintentionally, the waist belt 101 is not released from the user's waist to prevent the baby or the infant from falling down.

The waist belt 101 according to the preferred embodiment of the present invention does not generate any noise when the user unfastens the waist belt 101 in order to lay down the baby or the infant sleeping in the baby carrier, such that the baby or the infant does not awake from sleep.

In the state where the user wears the waist belt 101 around his or her waist, a process to unfasten the waist belt 101 is as follows.

Figure 4:
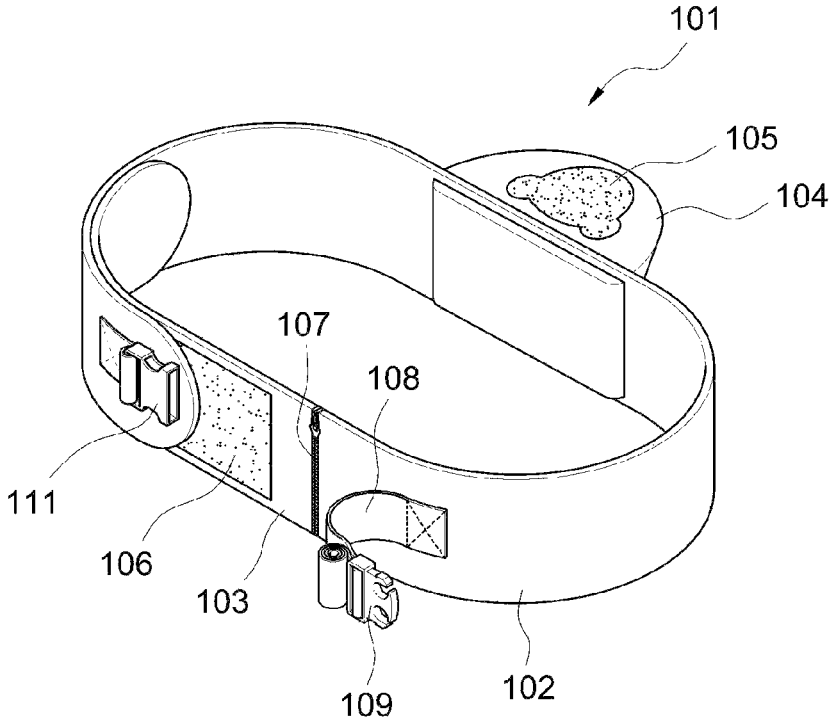

First, as shown in FIG. 4, the user releases the coupling of the fastening buckle 109 and the fixed buckle 111 to unfasten the safety belt 108 which fixes both ends of the first belt 102.

Figure 5:
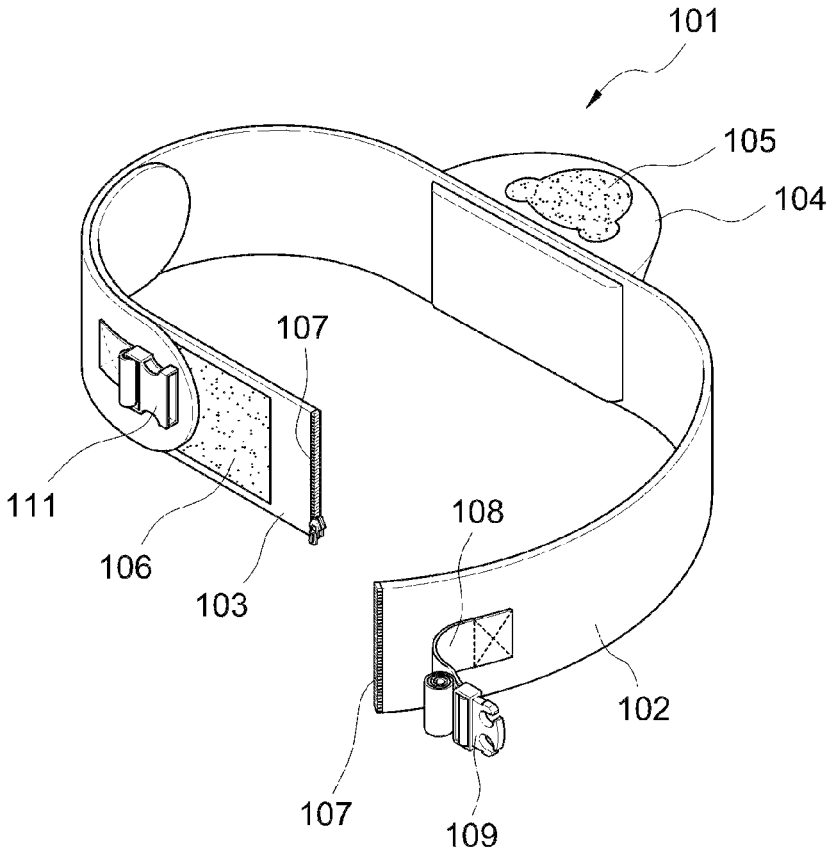

Additionally, the user does not release the Velcro fastener 106, which fixes the first belt 102 and the second belt 103, but opens the zipper 107, which fixes the first belt 102 and the second belt 103 as shown in FIG. 5, such that the first belt 102 and the second belt 103 are separated from each other to simply unfasten the waist belt 101 from the user's waist.

In this instance, for the zipper 107, preferably, a 'locking zipper' which is fixed to the zipper rails not to move in a state where a slider handgrip of the zipper is folded is used. The locking zipper is well-known, and so, its detailed description is omitted.

That is, because there is no need to detach the Velcro fasteners 106 from each other but the user simply opens the zipper 107 in order to unfasten the waist belt 101 from the user's waist, the no-noise detachable baby carrier belt does not generate a loud noise and allows the user to rapidly unfasten the waist belt 101 from the user's waist.

Moreover, because the safety belt 108 fastens and fixes both end portions of the first belt 102, the no-noise detachable baby carrier belt can prevent the baby or the infant from falling down due to unintentional opening of the zipper 107.

As described above, in order to unfasten the waist belt 101 from the user's waist, the user can release the waist belt 101 by detaching the Velcro fasteners 106 from each other in the same way as the conventional method or by opening the zipper 107 in the state where the Velcro fasteners 106 are attached to each other.

In this embodiment, in order to prevent the zipper 107 from being opened unintentionally, the safety belt 108 which connects both end portions of the first belt 102 is fastened by buckles, but may be fastened by other various known fastening means, such as snap buttons, and it should be understood that it belongs to the scope of the present invention.

Figure 7:
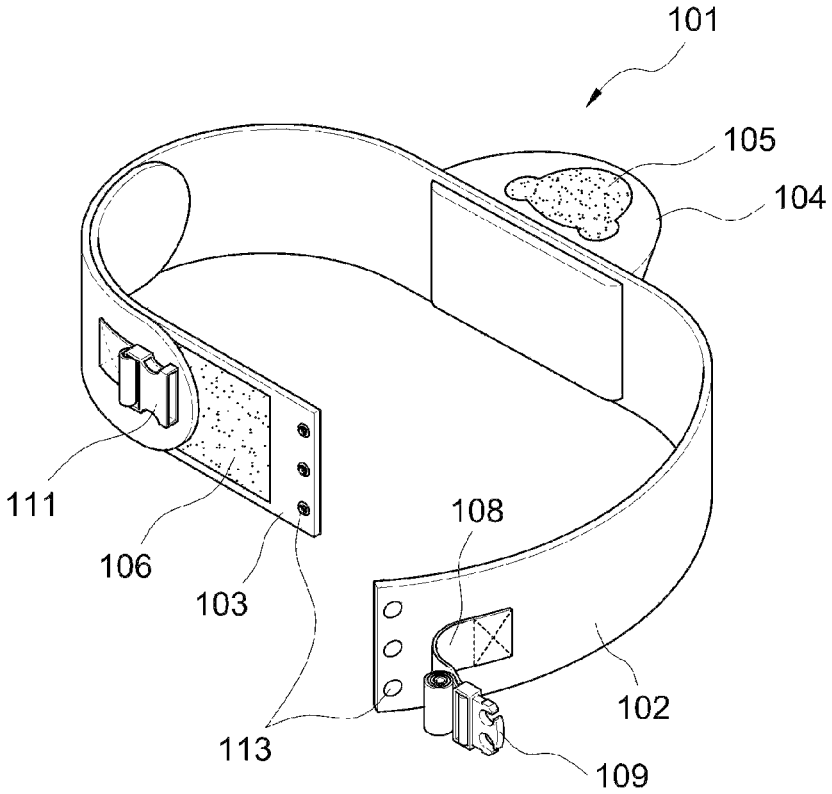
FIGS. 7 and 8 are perspective views showing a baby carrier belt having belt fastening means of different types.
Figure 8:
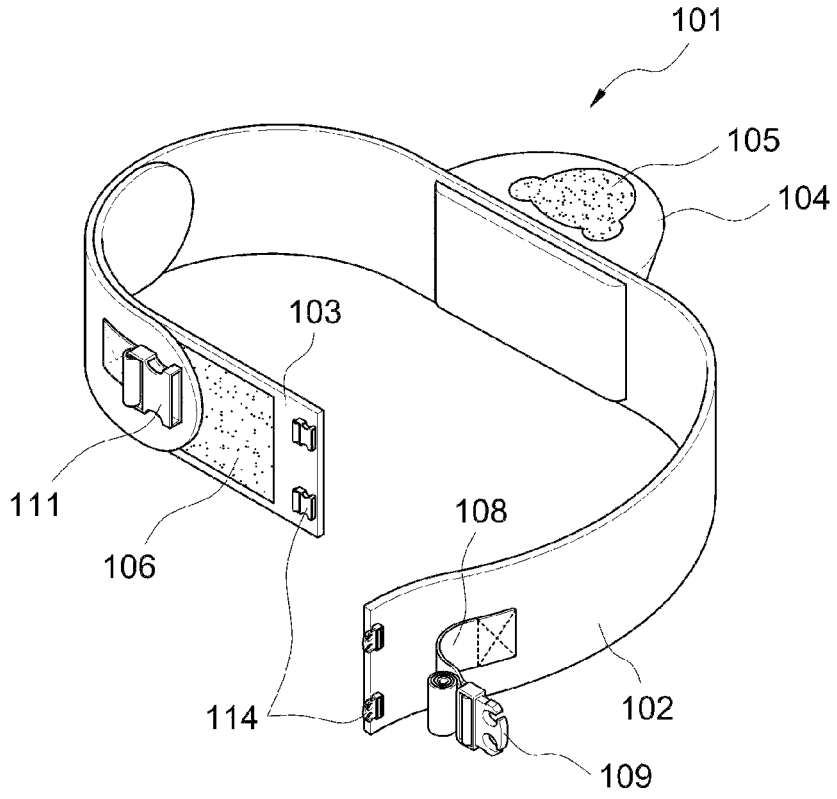

Furthermore, in this embodiment, the zipper 107 is used as the belt fastening means for fastening the first belt 102 and the second belt 103 with each other, but snap buttons 113 may be used to fasten the first belt 102 and the second belt 103 as shown in FIG. 7. Alternatively, buckles 114 may be used as the belt fastening means to fasten the first belt 102 and the second belt 103 as shown in FIG. 8.

Additionally, as a fastening means for the safety belt 108, snap buttons may be used, but it is preferable to use buckles which are not released by an external force because the snap buttons may be released unintentionally by an external force.

The baby carrier belt according to the preferred embodiment of the present invention may be used as the waist belt

Figure 6:
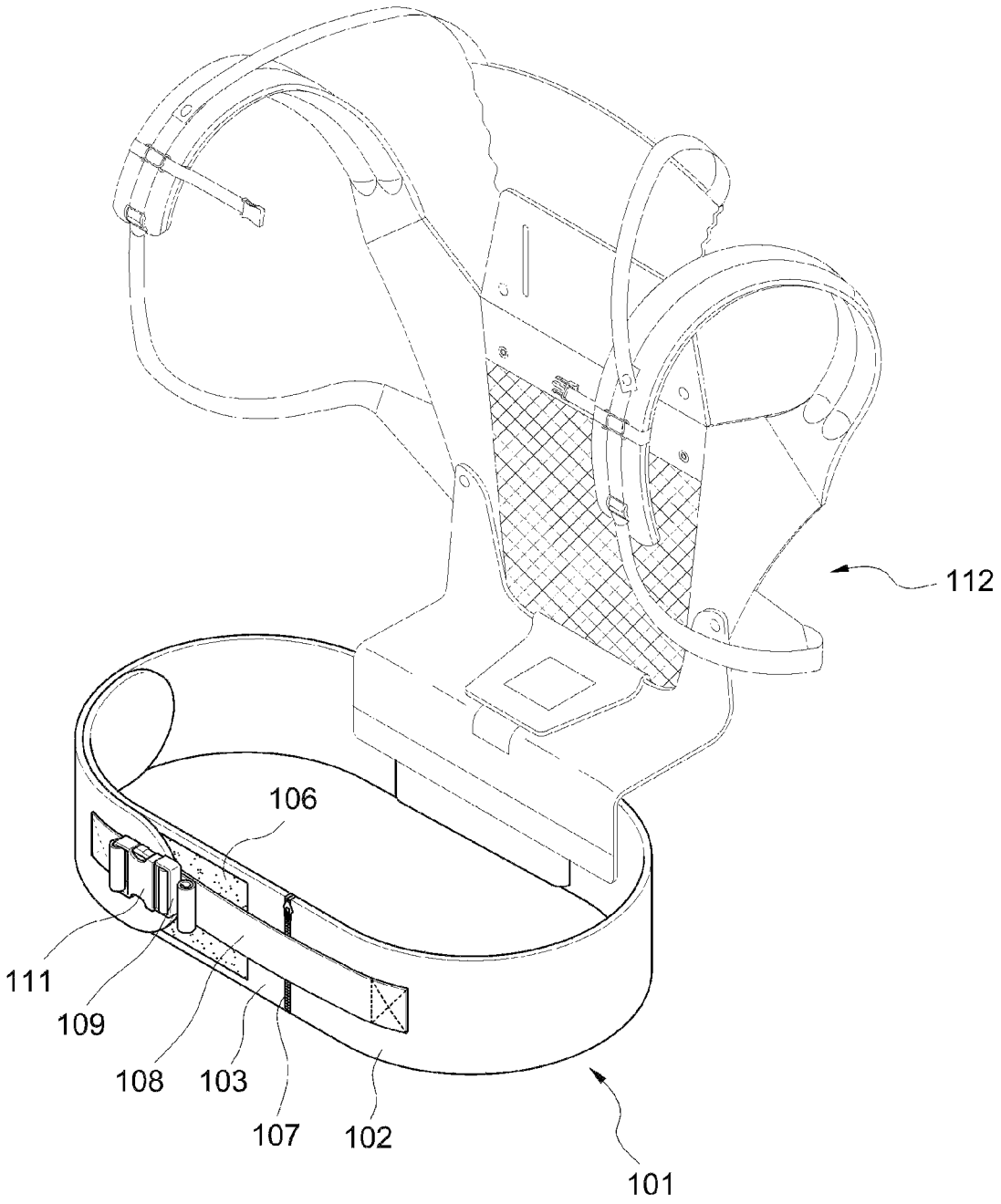
FIG. 6 is a perspective view showing a state where a baby carrier is combined to the baby carrier belt according to the preferred embodiment of the present invention.

101 having the hip seat 104, or may be used in the state where the baby carrier 112 is combined to the waist belt 101 as shown in FIG. 6.

As described above, the technical thoughts of the present invention have been described.

It is to be appreciated that those skilled in the art can change or modify the exemplary embodiment from the above description. Although it is not clearly illustrated or described herein, it is to be appreciated that those skilled in the art can change or modify the exemplary embodiment from the above description without departing from the scope and spirit of the present invention, and such changes or modifications belong to the scope of the present invention. While the present invention has been described with reference to the particular illustrative embodiment, it is not to be restricted by the exemplary embodiment but only by the appended claims.

The invention claimed is:

1. A no-noise detachable baby carrier belt comprising:

a first belt having a zipper formed at one end portion to be fastened to a second belt and a hook and loop fastener formed at the other end portion;

the second belt having the zipper formed at one end portion to be fastened to the first belt and a hook and loop fastener formed on one side thereof; and a safety belt having fastening means for fastening both end portions of the first belt, so as to prevent the zipper from being released unintentionally in a state where a user wears a waist belt around the user's waist, wherein the first belt and the second belt are fastened to each other by the zipper to form the waist belt, and the waist belt is released from the user's waist by detaching the hook and loop fasteners from each other or by unfastening the zipper in the state where the user wears the waist belt around the user's waist by attaching the hook and loop fasteners to each other.

2. The no-noise detachable baby carrier belt according to claim 1, wherein the fastening means are buckles.

3. The no-noise detachable baby carrier belt according to any one of claims 1 or 2, wherein the first belt further includes a hip seat for supporting a baby's hips.

4. The no-noise detachable baby carrier belt of claim 3, wherein the hip seat comprises a non-slip pad.

5. The no-noise detachable baby carrier belt according to any one of claims 1 or 2, wherein the first belt further includes a baby carrier for supporting a baby's upper body.

6. The no-noise detachable baby carrier belt of claim 1, wherein the safety belt overlaps the zipper when the waist belt is fastened.

7. The no-noise detachable baby carrier belt of claim 1, wherein the safety belt overlaps the hook and loop fastener when the waist belt is fastened.

* * * * *